US010458239B2

(12) United States Patent
Terada

(10) Patent No.: US 10,458,239 B2
(45) Date of Patent: Oct. 29, 2019

(54) OIL PUMP HAVING PLURALITY OF OUTER ROTOR PIECES

(71) Applicant: AISIN SEIKI KABUSHIKI KAISHA, Kariya-shi, Aichi-ken (JP)

(72) Inventor: Mitsuru Terada, Okazaki (JP)

(73) Assignee: AISIN SEIKI KABUSHIKI KAISHA, Kariya-Shi, Aichi-Ken (JP)

( * ) Notice: Subject to any disclaimer, the term of this patent is extended or adjusted under 35 U.S.C. 154(b) by 208 days.

(21) Appl. No.: 15/500,891

(22) PCT Filed: Sep. 25, 2015

(86) PCT No.: PCT/JP2015/077064

§ 371 (c)(1),
(2) Date: Jan. 31, 2017

(87) PCT Pub. No.: WO2016/076020

PCT Pub. Date: May 19, 2016

(65) Prior Publication Data

US 2017/0218759 A1 Aug. 3, 2017

Related U.S. Application Data

(63) Continuation of application No. PCT/JP2015/077064, filed on Sep. 25, 2015.

(30) Foreign Application Priority Data

Nov. 12, 2014 (JP) ..... 2014-229616

(51) Int. Cl.
*F01C 1/336* (2006.01)
*F01C 1/08* (2006.01)
(Continued)

(52) U.S. Cl.
CPC ..... *F01C 1/336* (2013.01); *F01C 21/08* (2013.01); *F04C 2/332* (2013.01); *F04C 2/336* (2013.01);
(Continued)

(58) Field of Classification Search
CPC ..... F01C 1/336; F01C 1/332; F01C 21/08; F04C 2/332; F04C 2/336; F04C 2/3448;
(Continued)

(56) References Cited

U.S. PATENT DOCUMENTS 2,313,246 A * 3/1943 Kendrick ..... F04C 14/20 418/26
3,527,552 A * 9/1970 Lincks ..... F01C 21/106 418/179
(Continued)

FOREIGN PATENT DOCUMENTS

JP 2012-255439 A 12/2012
WO WO 2015/045744 A1 4/2015

OTHER PUBLICATIONS

International Search Report (PCT/ISA/210) dated Dec. 22, 2015, by the Japanese Patent Office as the International Searching Authority for International Application No. PCT/JP2015/077064.
(Continued)

*Primary Examiner* — Deming Wan
(74) *Attorney, Agent, or Firm* — Buchanan Ingersoll & Rooney PC

(57) ABSTRACT

This oil pump includes a first volume-changing part provided between an inner rotor and an outer rotor and a second volume-changing part provided in the outer rotor. A plurality of outer rotor pieces, which is annularly connected to each other, of the outer rotor is circumferentially arranged in a state where a first engaging part and a second engaging part of the outer rotor pieces being adjacent to each other engage
(Continued)

with each other such that a distance therebetween in a circumferential direction is variable.

5 Claims, 4 Drawing Sheets

(51) Int. Cl.
*F04C 2/332* (2006.01)
*F04C 2/336* (2006.01)
*F04C 14/22* (2006.01)
*F01C 21/08* (2006.01)

(52) U.S. Cl.
CPC ..... *F04C 14/223* (2013.01); *F04C 2210/206* (2013.01)

(58) Field of Classification Search
CPC ..... F04C 14/223; F04C 2210/206; F04C 13/001; F04C 15/06
USPC ..... 418/16, 23, 24, 26
See application file for complete search history.

(56) References Cited

U.S. PATENT DOCUMENTS

2007/0292292 A1* 12/2007 Schneider ..... F01C 21/0836 418/24
2016/0215775 A1 7/2016 Terada

OTHER PUBLICATIONS

Written Opinion (PCT/ISA/237) dated Dec. 22, 2015, by the Japanese Patent Office as the International Searching Authority for International Application No. PCT/JP2015/077064.

* cited by examiner (ASSEMBLY VIEW OF PUMP ELEMENT)

R: ROTATION CENTER OF INNER ROTOR, U: ROTATION CENTER OF OUTER ROTOR

OIL PUMP HAVING PLURALITY OF OUTER ROTOR PIECES

TECHNICAL FIELD

The present invention relates to an oil pump, and more particularly, it relates to an oil pump including an inner rotor, an outer rotor, and a plurality of vanes that connects the inner rotor and the outer rotor.

BACKGROUND ART

In general, an oil pump including an inner rotor, an outer rotor, and a plurality of vanes that connects the inner rotor and the outer rotor is known. Such an oil pump is disclosed in Japanese Patent Laying-Open No. 2012-255439, for example.

In Japanese Patent Laying-Open No. 2012-255439, there is disclosed a pendulum-slider pump (oil pump) including an inner rotor rotationally driven, an enter rotor rotated outside the inner rotor, and a plurality of pendulums (vanes) chat connects the outer periphery of the inner rotor and the inner periphery of the outer rotor. In this pendulum-slider pump described in Japanese Patent Laying-Open No. 2012-255439, tip ends of the pendulums are hinged to the outer periphery of the inner rotor, and base parts thereof are fitted into recess parts of the outer rotor formed, to correspond to the respective pendulums. In response to relative eccentricity between the inner rotor and the outer rotor, each of the pendulums is rotationally moved while swinging about, a connecting part with the inner rotor along with the rotation of the inner rotor, and the base parts of the pendulums are displaced to freely appear from and disappear into the recess parts of the outer rotor. At this time, a plurality of volume chambers individually partitioned by the pendulums is sequentially deformed along with the rotation of the inner rotor, thereby providing a pulping function.

Furthermore, in order to cause the pendulums to swing, intermediate parts of the respective pendulums that connect one ends and the other ends are narrower than both ends (the tip ends and the base parts). Thus, the intermediate parts that enter the recess parts of the outer rotor are prevented from contacting with inner walls of the recess parts due to swinging of the pendulums. In addition, each of the pendulum swings, whereby both the inner rotor and the outer rotor having relative eccentricity smoothly rotate.

PRIOR ART

Patent Document

Patent Document 1: Japanese Patent Laying-Open No. 2012-255439

SUMMARY OF THE INVENTION

Problem to be Solved by the Invention

In the pendulum-slider pump described in Japanese Patent Laying-Open No. 2012-255439, although the plurality of volume chambers partitioned by the pendulums is sequentially repetitively deformed along with the rotation of the inner rotor, thereby providing the pumping function, it is conceivably difficult to sufficiently utilize the amount of change in volume other than the volume of the plurality of volume chambers partitioned by the pendulums. Thus, there is such a problem that a net rate of discharge of oil per unit rotation cannot be sufficiently increased.

The present invention has been proposed in order to solve the aforementioned problem, and an object of the present invention is to provide an oil pump capable of sufficiently increasing a net rate of discharge of oil per unit rotation.

Means for Solving the Problem

In order to attain the aforementioned object, an oil pump according to an aspect of the present invention includes a rotatable inner rotor including a vane-housing unit that houses a plurality of vanes such that the plurality of vanes is slidable in a radial direction, a rotatable annular outer rotor including a plurality of vane-connecting parts connected with tip ends of the plurality of vanes located radially outward, a first volume-changing part, which is provided between the inner rotor and the outer rotor, a first volume of which is changed in response to eccentricity of the inner rotor with respect to the outer rotor, thereby providing a pumping function, and a second volume-changing part, which is provided in the outer rotor, a second volume of which is changed by a change in a distance between the vane-connecting parts adjacent to each other in a circumferential direction in response to the eccentricity of the inner rotor with respect to the outer rotor, thereby providing a pumping function. The outer rotor includes a plurality of outer rotor pieces annularly connected to each other, each of the plurality of outer rotor pieces includes a first engaging part provided in a first end surface in an axial direction and a second engaging part provided in a second end surface in the axial direction and being capable of engaging with the first engaging part of an adjacent one of the outer rotor pieces, and the plurality of outer rotor pieces is circumferentially arranged in a state where the first engaging part and the second engaging part of the outer rotor pieces being adjacent to each, other engage with each other such that a distance therebetween in the circumferential direction is variable.

In the oil pump according to this aspect of the present invention, in addition to the highly-efficient pumping of the first volume-changing part partitioned by the vanes, the pumping of the second volume-changing part newly provided in the outer rotor can be effectively utilized. Thus, a net rate of discharge of oil per unit rotation in the oil pump can be sufficiently increased. Consequently, the pumping efficiency can be improved. When compared at the same rate of discharge, the oil pump can be reduced in size, and hence the mountability of the oil pump to a device can be improved. Furthermore, the oil pump is reduced in size so that a mechanical loss during driving of the oil pump can be reduced, and hence the load of a drive source that drives the oil pump is reduced so that the energy can be saved.

Furthermore, in the aforementioned oil pump according to this aspect, each of the plurality of outer rotor pieces includes the first engaging part provided in the first end surface in the axial direction and the second engaging part provided in the second end surface in the axial direction and being capable of engaging with the first engaging part of the adjacent one of the outer rotor pieces, and the plurality of outer rotor pieces is circumferentially arranged in a state where the first engaging part and the second engaging part of the outer rotor pieces being adjacent to each other engage with each other such that the distance therebetween in the circumferential direction is variable.

Thus, a contact part between the outer rotor pieces can be limited only to an overlapping part in the circumferential direction between the first end surface and the second end surface in the axial direction, and hence a sliding resistance between the outer rotor pieces can be reduced. Furthermore, the second volume-changing part can be configured by only engagement between the first engaging part of the first end surface and the second engaging part of the second end surface in the axial direction, and hence the thickness (the widths of the first end surface and the second end surface in the radial direction) of each of the outer rotor pieces in the radial direction can also be further reduced within a range in which the strength can be maintained so that the weight can be reduced. The reduction in the sliding resistance between the outer rotor pieces of the outer rotor annularly (circumferentially) connected to each other and the reduction in weight lead to a reduction in mechanical loss, which can further contribute to a reduction in the load of the drive source (energy saving).

In the aforementioned oil pump according to this aspect, the first end surface and the second end surface are preferably end surfaces provided inward of both ends of each of the outer rotor pieces in the axial direction. Thus, the first engaging part of the first end surface and the second engaging part of the second end surface of the adjacent outer rotor pieces annularly connected to each other can reliably engage with each other so that the second volume-changing part having the pumping function can be easily configured.

In the aforementioned oil pump according to this aspect, the first engaging part is preferably provided in the first end surface of each of the outer rotor pieces in the axial direction to extend in an arcuate manner, the second engaging part is preferably provided in the second end surface of each of the outer rotor pieces in the axial direction to extend in an arcuate manner, and the first engaging part and the second engaging part preferably engage with each other such that the same are slidable in the circumferential direction which respect to each other in an engaging state.

According to this structure, an outer rotor piece on one side and an outer rotor piece on the other side are relatively slid in a state where the arcuate first engaging part of the outer rotor piece on one side and the arcuate second engaging part of the outer rotor piece on the other side engage with each other, whereby sliding in an arcuate manner is easily enabled, and hence the distance between the adjacent outer rotor pieces in the circumferential direction can be easily changed in a forward direction and a backward direction along the circumferential direction. Therefore, the second volume of the second volume-changing part formed between the adjacent outer rotor pieces is increased (decreased) along the circumferential direction so that the pumping function can be provided.

In the aforementioned structure in which the first engaging part extends in an arcuate manner and the second engaging part extends in an arcuate manner, the first engaging part is preferably formed by one of a convex part and a concave part provided in the first end surface of each of the outer rotor pieces in the axial direction to extend in an arcuate manner, and the second engaging part is preferably formed by the other of the convex part and the concave part provided in the second end surface of each of the outer rotor pieces in the axial direction to extend in an arcuate manner and being capable of engaging with the first engaging part of the adjacent one of the outer rotor pieces.

According to this structure, the outer rotor pieces can be easily relatively slid in an arcuate manner in a state where one of the arcuate convex part and concave part of the outer rotor piece on one side and the other of the arcuate convex part and concave part of the outer rotor piece on the other side engage with each other. Furthermore, a periodic change in the volume of the second volume-changing part can be achieved by a simple engagement structure in which the convex part is fitted into the concave part, and hence the durability of the outer rotor can be easily maintained.

In the aforementioned structure in which the first engaging part is formed by one of the convex part and the concave part and the second engaging part is formed by the other of the convex part and the concave part, the convex part is preferably a rail part that extends in an arcuate manner, and the concave part is preferably a groove part that engages with the rail part and extends in an arcuate manner, one end of which is open.

According to this structure, the outer rotor pieces can be easily relatively slid in an arcuate manner in a state where the rail part, which extends in an arcuate manner, of the outer rotor piece on one side engages with (is fitted into) the groove part, which extends in an arcuate manner, of the outer rotor piece on the other side. In this case, one end of the groove part is open, whereby the oil in the groove part can be discharged from one end (open end) according to a decrease in volume even under the circumstances in which the rail part (convex part) is slidingly inserted into the groove part (concave part) in the circumferential direction so that the spatial volume of the groove part is decreased, and hence liquid compression of the oil in the groove part can be avoided. Thus, each of the outer rotor pieces can smoothly slide in the circumferential direction, and hence the periodic change in the volume of the second volume-changing part can be smoothly made.

In this case, a depth of the groove part in the axial direction is preferably larger than a protruding height of the rail part.

According to this structure, a clearance can be formed between a top part of the rail part and a bottom part of the groove part in an engaging state where the rail part is fitted into the groove part, and hence this clearance serves as a flow path for oil discharge so that the oil in the groove part can be easily discharged from one end (open end) even when the rail part is slidingly inserted into the groove part in the circumferential direction. Therefore, liquid compression of the oil can be easily avoided.

In the aforementioned oil pump according to this aspect, each of the outer rotor pieces preferably includes a first part, that extends in an arcuate manner to one side in the circumferential direction with respect to each of the vane-connecting parts and includes the first end surface provided with the first engaging part, and a second part chat extends in an arcuate manner to the other side in the circumferential direction with respect to each of the vane-connecting parts and includes the second end surface provided with the second engaging part, and a radially outermost surface of each of the outer rotor pieces preferably includes an outer peripheral surface of the first part and an outer peripheral surface of the second part.

According to this structure, an outer peripheral surface of each of the outer rotor pieces can be configured such that the outer peripheral surface of the first part and the outer peripheral surface of the second part circumferentially continue without steps. Therefore, the thickness of each of the outer rotor pieces in the radial direction can be reduced due to no steps, and hence the diameter of the outer rotor can be reduced.

According to the present application, the following structure is also conceivable in the aforementioned oil pump according to this aspect.

Specifically, in the aforementioned oil pump according to this aspect, the first end surface and the second end surface are provided at the same height position in the axial direction.

The aforementioned oil pump according to this aspect further comprises a third volume-changing part, a third volume of which in the vane-housing unit of the inner rotor is changed toy sliding of the plurality of vanes in the radial direction in response to the eccentricity of the inner rotor with respect to the outer rotor, therefore providing a pumping function.

Effect of the Invention

According to the present invention, as hereinabove described, the net rate of discharge of the oil per unit rotation can be sufficiently increased.

MODES FOR CARRYING OUT THE INVENTION

An embodiment of the present invention is hereinafter described on the basis of the drawings.

The structure of an oil pump 100 according to the embodiment of the present invention is now described with reference to FIGS. 1 to 8.

Figure 1:
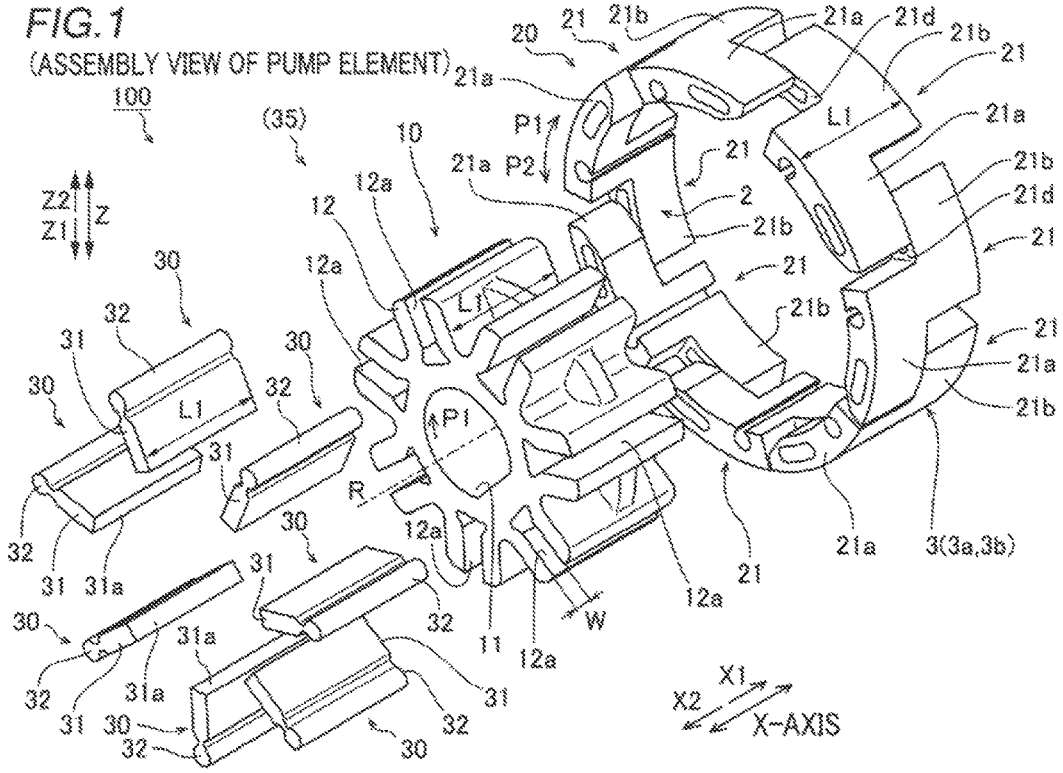
FIG. 1 An exploded perspective view showing the structure of an oil pump according to an embodiment of the present invention.

The oil pump 100 according to the embodiment of the present invention includes an inner rotor 10, an outer rotor 20, and seven vanes 30 that connect these, as shown in FIG. 1. The inner rotor 10, the outer rotor 20, and the seven vanes 30 constitute a pump element 35 having a pumping function.

Figure 2:
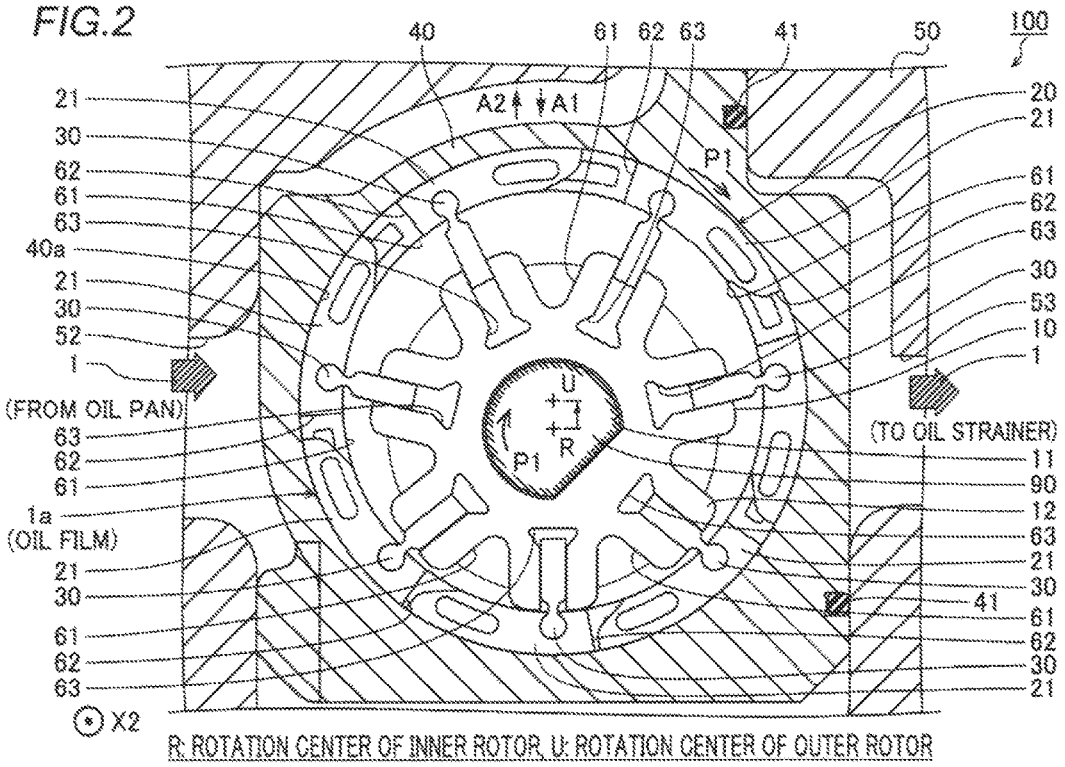
FIG. 2 A diagram showing the internal structure of the oil pump according to the embodiment of the present invention.

The oil pump 100 includes a housing 40 that houses the annular outer rotor 20 such that the outer rotor 20 is rotatable along arrow P1 and a pump body 50 that houses the housing 40 such that the housing 40 is movable, as shown in FIG. 2. The oil pump 100 has a function of supplying oil (lubricating oil) 1 in an oil pan of an internal combustion engine (engine) around pistons (not shown) and to a movable part (slide part) such as a crankshaft (not shown). The housing 40 is made of an iron-based metal material, and the pump body 50 is made of an aluminum alloy.

As shown in FIG. 2, the oil pump 100 also includes a suction port 52 and a discharge port 53 that are formed in the pump body 50 behind the housing 40. The pump body 50 is closed by a cover (not shown) from the front side of the plane of the figure. The pump body 50 is provided with seven volume chambers 61 (examples of a first volume-changing part) surrounded by the inner rotor 10, the outer rotor 20, and the seven vanes 30, respectively. The volumes of the volume chambers 61 are increased or decreased in response to enlargement or shrinkage in the shapes of the volume chambers 61 resulting from expansion and contraction (sliding) of the vanes 30 during the operation of the oil pump 100. The inner rotor 10 and the outer rotor 20 are made of an iron-based metal material, and the vanes 30 are made of an aluminum alloy.

The housing 40 is movable along arrow A1 (A2) with respect to the pump body 50 by drive force such as oil pressure. In other words, whereas a rotation center R of a drive shaft 90 of the inner rotor 10 is fixed, the housing 40 is moved such that a rotation center U of the outer rotor 20 is eccentric by a predetermined amount relative to the rotation center R. In the oil pump 100, the rotation center U of the outer rotor 20 is eccentric by the predetermined amount relative to the rotation center R of the inner rotor 10, as shown in FIG. 2 such that the pump element 35 provides the pumping function. A sliding surface of the housing 40 to the pump body 50 on the side of the discharge port 53 is provided with sealing members 41 that prevent the oil 1 on the side of the discharge port 53 from being leaked to the suction port 52 in the housing 40.

The inner rotor 10 includes a shaft hole 11 in its central part that serves as the rotation center R, as shown in FIG. 1. As shown in FIG. 2, the drive shaft 90 is connected to the shaft hole 11 so that the inner rotor 10 is rotated along arrow P1. The crankshaft (not shown) of the engine is used as a drive source for the inner rotor 10. The inner rotor 10 includes a vane-housing unit 12 provided along the outer periphery of the inner rotor 10.

The vane-housing unit 12 includes seven recess parts 12*a* that extend in a radial direction from the outer periphery of the inner rotor 10 toward the rotation center R. The recess parts 12*a* each have a predetermined depth in the radial direction, and the recess parts 12*a* are arranged at seven equal intervals (about 51.43-degree intervals) about the shaft hole 11. The recess parts 12*a* each extend in the form of a groove from an end surface of the inner rotor 10 on an X2 side to an end surface of the inner rotor 10 on an X1 side, as shown in FIG. 1. A width W between inner wall surfaces, which, extend in an X-axis direction, of each of the recess parts 12*a* that slidably hold the vanes 30 is constant. The inner rotor 10 has a predetermined rotor width L1 in the X-axis direction, and the rotor width L1 is equal to the lengths (widths) of the outer rotor 20 and the housing 40 in the X-axis direction (an example of an axial direction).

The outer rotor 20 includes seven outer rotor pieces 21, as shown in FIGS. 1 and 2. The outer rotor pieces 21 are sequentially connected to (engage with) each other in a circumferential direction such that the outer rotor 20 is rotated along arrow P1 in a state where the outer rotor pieces 21 are annularly connected to each other along the inner peripheral surface 40*a* of the housing 40.

Figure 3:
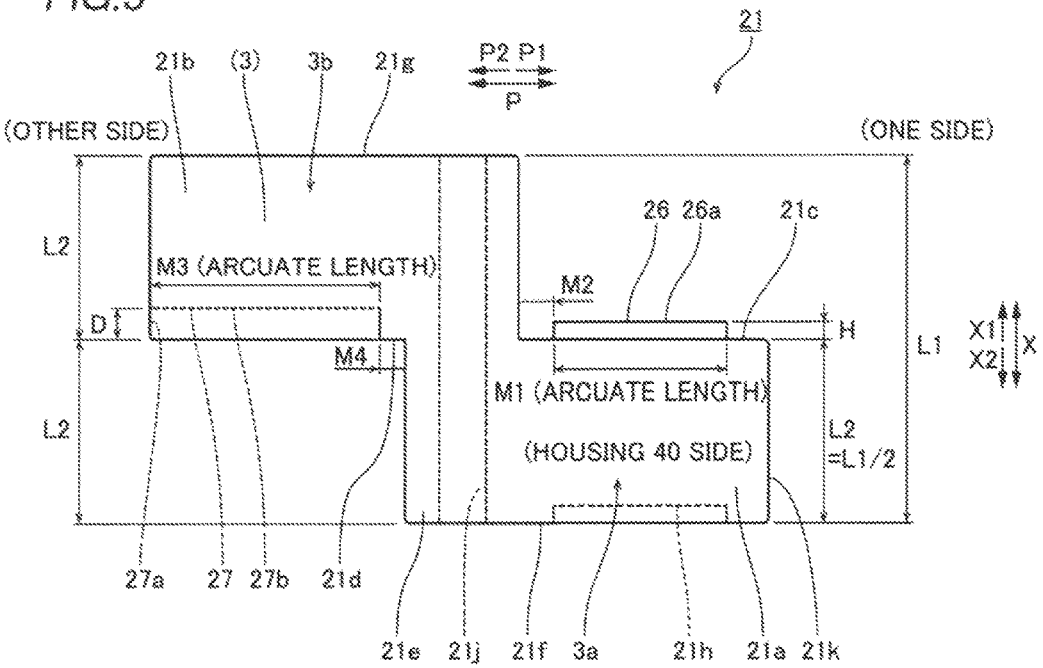
FIG. 3 A diagram showing an outer rotor piece constituting the oil pump according to the embodiment of the present invention.

When the respective outer rotor pieces 21 are viewed from an outer peripheral surface side (radially outermost surface 3), the outer rotor pieces 21 each include a first part 21*a* that extends in at arcuate manner (see FIG. 4) from its central part to one side (along arrow P1) and a second part 21*b* that extends in an arcuate manner from its central part to the other side (along arrow P2), as shown in FIG. 3. Base parts of the first part 21*a* and the second part 21*b* are connected to a base 21*e* (an example of a vane-connecting part) that extends in the X-axis direction of the outer rotor pieces 21. The widths L2 of the first part 21*a* and the second part 21*b* each are a half of the rotor width L1. In this case, the first part 21*a* extends, along, arrow FX from a half region of the base 21*e* on the X2 side, and the second part 21*b* extends along arrow P2 from, a half region of the base 21*e* on the X1 side. Therefore, each of the outer rotor pieces 21 is a unitary monolithic component in which the first part 21*a* and the second part 21*b* have such a shape that, an arcuate wing is spread in the circumferential direction about the base 21*e*.

Figure 4:
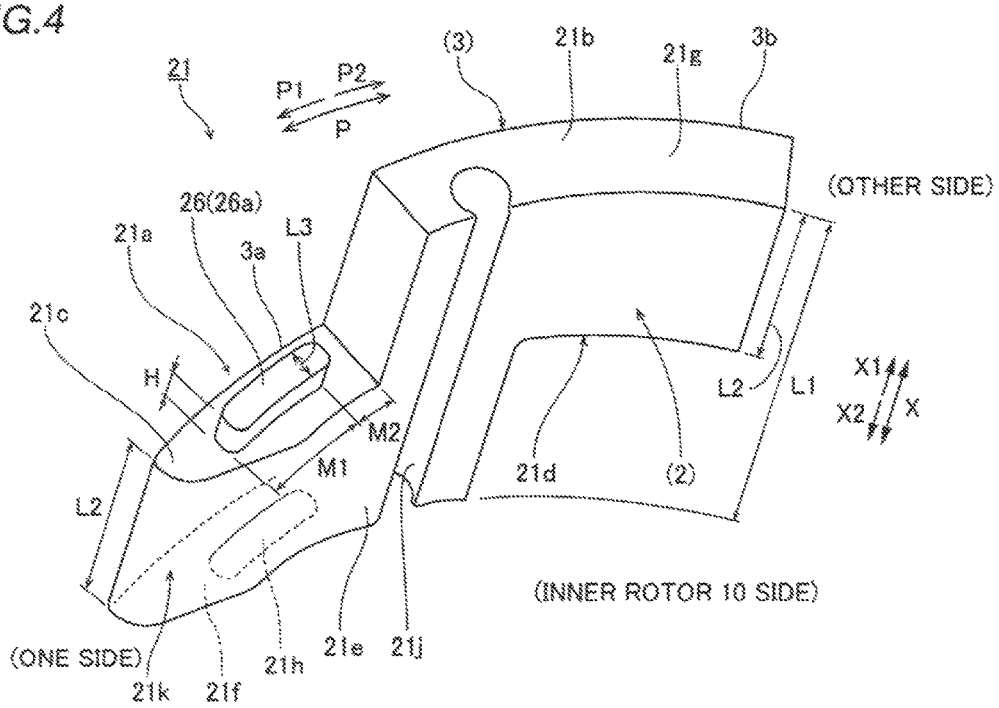
FIG. 4 A diagram showing the outer rotor piece constituting the oil pump according to the embodiment of the present invention.

According to this embodiment, the first part 21*a* includes a first end surface 21*c* that is formed on the X2 side in the X-axis direction, extends in an arcuate manner from the base 21*e* along arrow P1, and is perpendicular to the X-axis direction, as shown in FIGS. 3 to 4. The second part 21*b* includes a second end surface 21*d* that is formed on the X1 side in the X-axis direction, extends in an arcuate manner from the base 21*e* along arrow P2, and is perpendicular to the X-axis direction. The first end surface 21*c* and the second end surface 21*d* are end surfaces provided inward of both ends (outer end surfaces 21*f* and 21*g*) of each of the outer rotor pieces 21 in the X-axis direction. The second end surface 21*d* is arranged on a line that is an extension of the first end surface 21*c* along arrow P2, and the first end surface 21*c* and the second end surface 21*d* exist at the same height position in the axial direction. The first end surface 21*c* is provided with a rail part 26 (an example of a first engaging part) having a convex shape that protrudes along arrow X1, and the second end surface 21*d* is provided with a groove part 27 (an example of a second engaging part) having a concave shape that is recessed along arrow X1.

The rail part 26 extends in an arcuate manner along a central region of the first end surface 21*c* in the thickness direction (rotation radial direction) of the first part 21*a*. The rail part 26 is formed in an island shape in the first end surface 21*c*. As shown in FIG. 3, the rail part 26 extends with an arcuate length M1 from a position spaced at an interval M2 from the base 21*e* along arrow P1. A length from the first end surface 21*c* to a top surface 26*a* corresponds to the protruding height H of the rail part 26.

The groove part 27 extends in an arcuate manner along a central region of the second end surface 21*d* in the thickness direction of the second part 21*b*. One end 27*a* of the groove part 27 that corresponds to the tip end side of the second part 21*b* is exteriorly open. As shown in FIG. 3, the groove part 27 extends with an arcuate length M3 from a position spaced at an interval M4 from the base 21*e* along arrow P2. A length from the second end surface 21*d* to a bottom surface part 27*b* corresponds to the depth D of the groove part 27.

Figure 6:
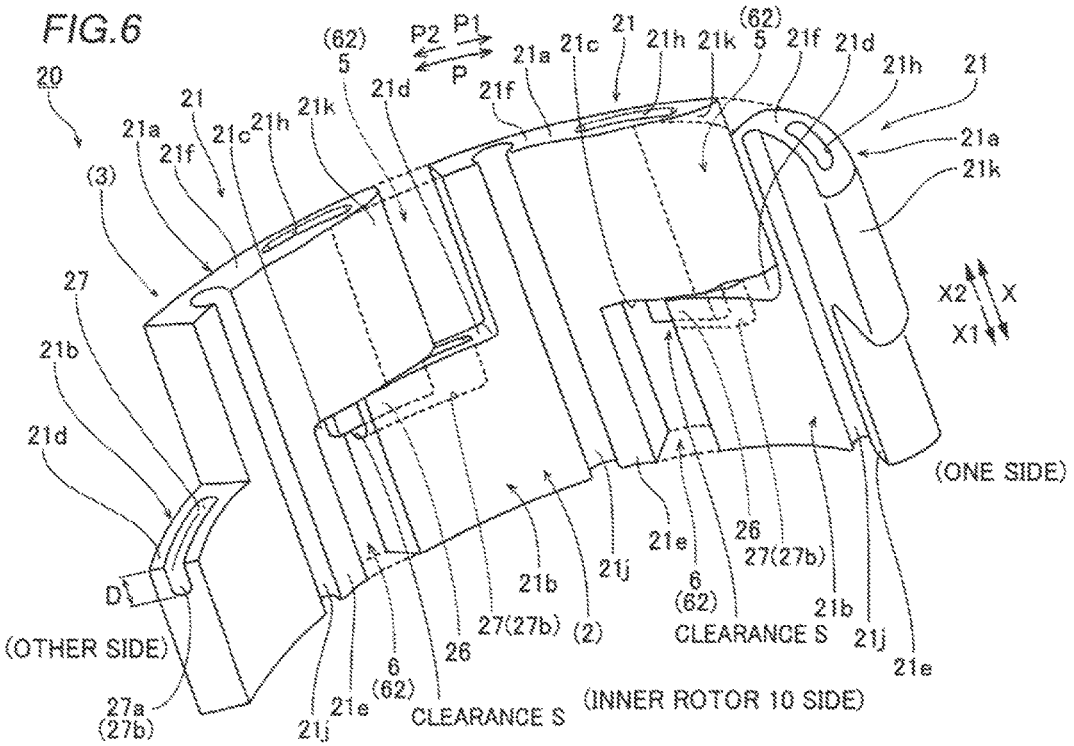
FIG. 6 A perspective view showing engagement between adjacent outer rotor pieces in the oil pump according to the embodiment of the present invention.
Figure 7:
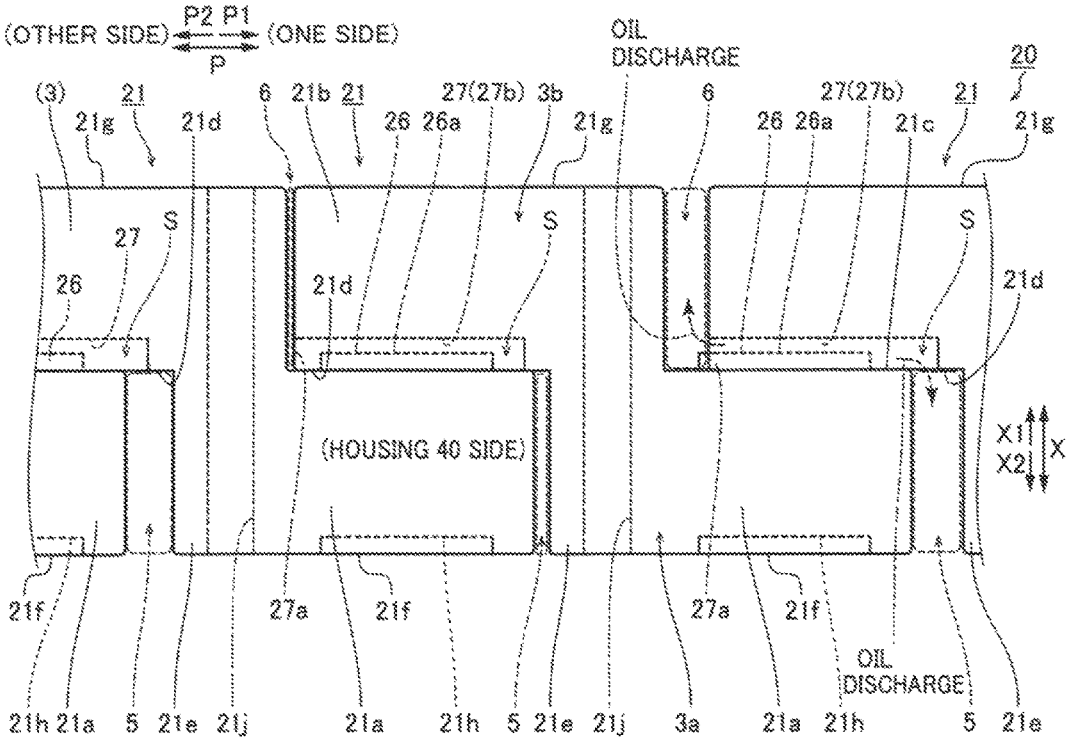
FIG. 7 A diagram planarly showing engagement between the adjacent outer rotor pieces in the oil pump according to the embodiment of the present invention.

According to this embodiment, when the respective outer rotor pieces 21 are circumferentially arranged, as shown in FIGS. 6 and 7, the rail part 26 and the groove part 27 of adjacent outer rotor pieces 21 engage with each other. In other words, when the seven outer rotor pieces 21 each including the first part 21*a* and the second part 21*b* arranged diagonally to each other are annularly connected to each other, the rail part 26 provided in the first end surface 21*c* of the first part 21*a* of an outer rotor piece 21 that serves as a reference is slidably fitted into the Groove part 27 provided in the second end surface 21*d* of the second part 21*b* of an outer rotor piece 21 adjacent on a P1 side. The groove part 27 provided in the second end surface 21*d* of she second part 21*b* of the same outer rotor piece 21 is fitted to the rail part 26 provided in the first end surface 21*c* of the first part 21*a* of an outer rotor piece 21 adjacent on a F2 side. Thus, the outer rotor 20 as a whole is circumferentially arranged in a state where the rail part 26 and the groove part 27 that face each other in the X-axis direction engage with each other such that the same are slidable in a direction P and the adjacent outer rotor pieces 21 engage with each other such that a distance therebetween in the circumferential direction is variable. In this case, the first end surface 21*c* of the first part 21*a* and the second end surface 21*d* of the second part 21*b* slide while coming into surface contact with each other.

As shown in FIG. 7, the depth D of the groove part 27 is larger than the protruding height H of the rail part 26. The arcuate length M3 of the groove part 27 is larger than the arcuate length M1 of the rail part 26. Thus, the volume (spatial volume) of the groove part 27 is larger than the volume (the volume of a part that protrudes from the first, end surface 21*c*) of the rail part 26. The interval M2 from the base 21*e* to a starting point of the rail part 26 is larger than the interval M4 from the base 21*e* to a starting point of the groove part 27. The width L4 (see FIG. 5) of the groove part 27 in a short-side direction is slightly larger than the width L3 (see FIG. 4) of the rail part 26 in the short-side direction. Thus, in a state where the rail part 26 is fitted into the groove part 27, as shown in FIGS. 6 and 7, a clearance S having a dimension (in the X-axis direction) that corresponds to a difference between the depth D and the protruding height H is provided between the top surface 26*a* of the rail part 26 and the bottom surface part 27*b* of the groove part 27.

The end surface 21*f* opposite to the first end surface 21*c* of the first part 21*a* slides with respect to the inner surface of the cover (not shown) that covers the end surface 21*f* from the front side of the plane of the figure, and the end surface 21*g* opposite to the second end surface 21*d* of the second part 21*b* slides with respect to the inner surface of the pump body 50. The end surface 21*f* is provided with a recess part 21*h* such that a sliding area thereof to the cover is decreased by the amount.

Figure 8:
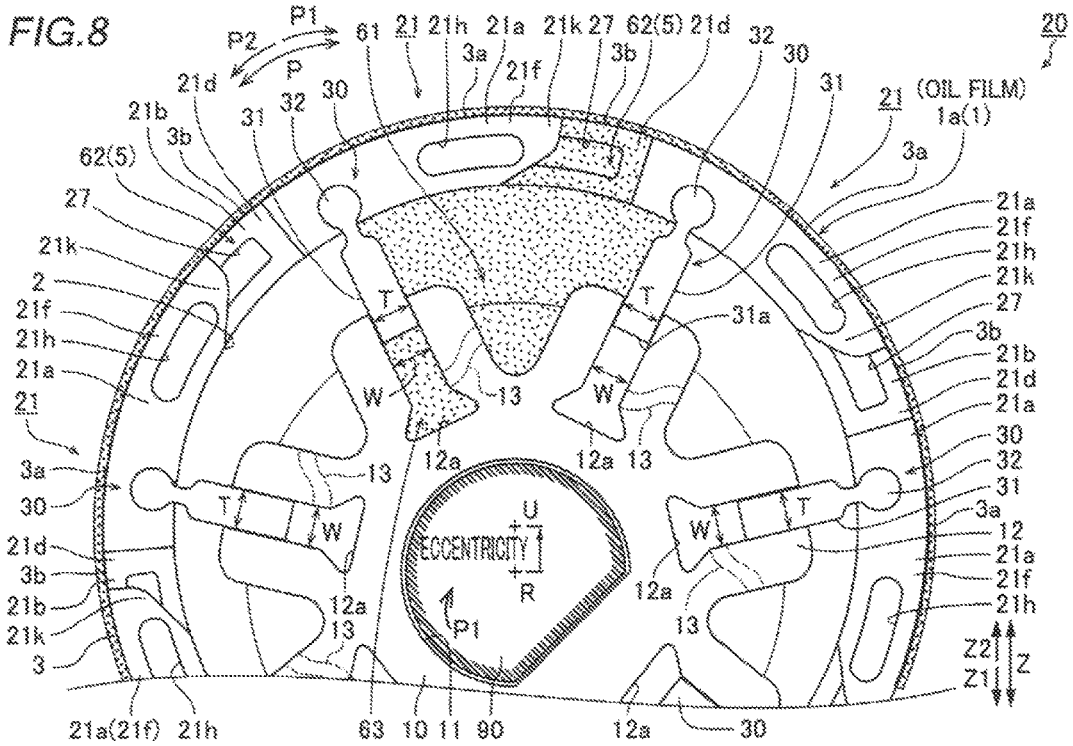
FIG. 8 A diagram partially showing the internal structure of the oil pump according to the embodiment of the present invention.

As shown in FIG. 8, the radially outermost surface 3 (see FIG. 3) of the outer rotor piece 21 includes the outer peripheral surface 3*a* (see FIG. 7) of the first part 21*a* and the outer peripheral surface 3*b* (see FIG. 7) of the second part 21*b*. More specifically, the radially outermost surface 3 of the outer rotor piece 21 is configured such that the outer peripheral surface 3*a* of the first part 21*a* and the outer peripheral surface 3*b* of the second part 21*b* circumferentially continue without steps, and the thickness of the outer rotor piece 21 in the radial direction is reduced due to no steps. The outer peripheral surface 3*a* (3*b*) of the first part 21*a* (second part 21*b*) circumferentially slides with respect to the inner peripheral surface 40*a* of the housing 40 through an oil film 1*a*.

The first part 21*a* and the second part 21*b* each are formed in an arcuate shape, and hence an overlapping margin (an area on which the first end surface 21*c* and the second end surface 21*d* overlap with each other) of the adjacent outer rotor pieces 11 in the direction P can be increased or decreased along arrow P1 or arrow P2 within a length range of the first part 21*a* and the second part 21*b* In the circumferential direction. Therefore, in the outer rotor 20 incorporated in the housing 40 (see FIG. 2), engagement between the adjacent outer rotor pieces 21 is maintained while a distance (engagement area) between the adjacent outer rotor pieces 21 in the circumferential direction is increased or decreased within a predetermined range.

According to this embodiment, engagement spaces 5 and 6 are formed between the outer rotor pieces 21 adjacent to each other. Specifically, the engagement space 5 (a part shown by a broken line) that enables increase and decrease in volume is formed in a region in which the first part 21*a* and the second part 21*b* face each other by engagement between the first part 21*a* of the outer rotor piece 21 that serves as a reference and the second part 21*b* of the outer rotor piece 21 adjacent on the P1 side, as shown in FIGS. 6 and 7. The engagement space 6 (a part shown by a broken line) that enables increase and decrease in volume is formed in a region in which the second part 21*b* and the first part 21*a* face each other by engagement between the second part 21*b* of the outer rotor piece 21 and the first part 21*a* of the outer rotor piece 21 adjacent on the P2 side. The outer peripheral surfaces of the engagement spaces 5 and 6 are defined by the inner peripheral surface 40*a* (see FIG. 2) of the housing 40. The inner peripheral surfaces of the engagement spaces 5 and 6 are defined by an inner surface 2 of the outer rotor 20 in the rotation radial direction, but as can be seen in FIG. 8, the engagement spaces 5 and 6 substantially communicate with a volume chamber 61.

A volume chamber 62 (an example of a second volume-changing part) is formed between the outer rotor pieces 21 that engage with each other by the aforementioned engagement spaces 5 and 6. The volume chamber 62 is configured such that increases or decreases in the volumes of the engagement spaces 5 and 6 are synchronized following a decrease or an increase in the engagement area (the area on which the first end surface 21*c* and the second end surface 21*d* overlap with each other) between the adjacent outer rotor pieces 21 in the circumferential direction within the predetermined range. More specifically, when the adjacent outer rotor pieces 21 are displaced in a direction away from each other, the engagement area is decreased, and the volumes of the engagement spaces 5 and 6 are increased. When the adjacent outer rotor pieces 21 are displaced in a direction coward each other, on the other hand, the engagement, area is increased, and the volume Vb is decreased. Repeated increases and decreases in the volumes of the engagement spaces 5 and 6 serve the pumping function of the outer rotor 20.

Figure 5:
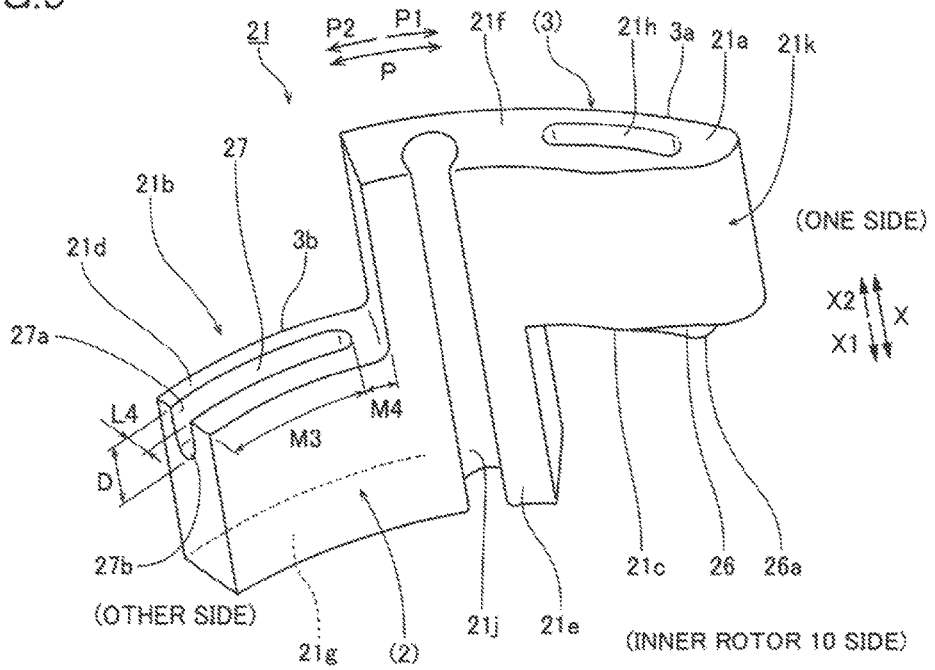
FIG. 5 A diagram showing the outer rotor piece constituting the oil pump according to the embodiment of the present invention.

As shown in FIGS. 4 and 5, the base 21*e* of each of the outer rotor pieces 21 is provided with an engaging part 21*j* (an example of the vane connecting part) formed by notching in a C-shape. The engaging part 21*j* extends from an end of the base 21*e* on the X2 side to an end of the base 21*e* on the X1 side along the axial direction along the axial direction of the base 21*e*, and passes through the base 21*e*. In other words, the length of the engaging portion 21*j* is equal to the width L1 (see FIG. 1) of each of the vanes 30.

As shown in FIGS. 6 and 8, a forward edge region 21*k* on the P1 side of the first part 21*a* of the outer rotor piece 21 has a slightly tapered shape by reducing a thickness in the radial direction. Thus, when the outer rotor 20 rotates along the inner peripheral surface 40*a*, the oil 1 (see FIG. 2) of the suction port 52 is easily drawn into the volume chambers 62 and 61 that are expanding their volumes.

The vanes 30 each include a base 31 and a tip end 32, as shown in FIG. 8. The base 31 includes a narrow part on the side of the tip end 32, and the tip end 32 is connected to a tip of this narrow part. The base 31 is configured to be inserted into a recess part 12*a* from the side of a base part 31*a*. The thickness T of the base 31 is constant along the radial direction. The width W of the recess part 12*a* is slightly larger than the thickness T of the base 31. Therefore, a plurality of vanes 30 is arranged in the recess parts 12*a* of the inner rotor 10 so as not to swing in the direction P, which is the rotation direction of the inner rotor 10, but so as to be capable of movement that involves the protrusion of tip ends 32 from the recess parts 12*a* to a radially outward side and the retraction of base parts 31*a* toward the recess parts 12*a* on a radially inward side.

A volume chamber 63 is formed in the vane-housing unit 12 of the inner rotor ID by the recess part 12*a* and the base part 31*a* of a vane 30. The vane 30 is slid to freely appear from and disappear into the recess part 12*a*, whereby the volume of the volume chamber 63 is increased or decreased. In other words, the volume of the volume chamber 63 is increased when the tip end 32 jumps out of the recess part 12*a*, and the volume of the volume chamber 63 is decreased when the base part 31*a* is drawn into the recess part 12*a*.

The tip end 32 is fitted into the engaging part 21*j* formed in the base 21*e* of the outer rotor piece 21. The cross-sectional area of the engaging part 21*j* is slightly larger than the cross-sectional area of the tip end 32. Thus, the vane 30 slides with respect to the recess part 12*a* in the radial direction regardless of a connection angle between the vane 30 and the outer rotor piece 21. Furthermore, the outer rotor 20 is configured to be rotatable in the housing 40 while maintaining an annular shape regardless of the connection angle between the vane 30 and the outer rotor piece 21 also on the side of the outer rotor pieces 21 annularly connected to each other.

Inside the inner rotor 10, a communication passage 13 (shown by a broken line in FIG. 8) that allows the volume chamber 63 and the volume chamber 61 to communicate with each other is formed. Thus, one volume chamber 61 located between the adjacent vanes 30, the volume chamber 62 formed between the outer rotor pieces 21 that engage with each other in the circumferential direction in this part, and the volume chamber 63 in the vicinity of the volume chamber 61 communicate with each other. More specifically, seven volume chambers, each of which has a set of these volume chambers 61 to 63, are formed in a state where the volume chambers are zoned around the inner rotor 10.

The operation of the oil pump 100 according to this embodiment is now described with reference to FIGS. 2 and 8.

The housing 40 that holds the outer rotor 20 is moved along arrow A2 on the basis of predetermined control operation, whereby the rotation center U of the outer rotor 20 is eccentric with respect to the rotation center R of the inner rotor 10, as shown in FIG. 2. Thus, the oil pump 100 performs the pumping function by increasing or decreasing the volume of the volume chamber 61, the volume of the volume chamber 62, and the volume of the volume chamber 63 in response to the eccentricity of the outer rotor 20 with respect to the inner rotor 10.

In this case, the radial slide position of the tip end 32 (see FIG. 8) of the vane 30 located radially outward is changed in response to the eccentricity of the outer rotor 20 with respect to the inner rotor 10, following the rotational movement of the outer rotor 20, whereby the volume chamber 61 repetitively operates to increase or decrease its volume. Specifically, when each volume chamber 61 sequentially passes through the vicinity of the suction port 52 (see FIG. 2) along arrow P1, the vane 30 gradually increases the amount of protrusion of the tip end 32 from the recess part 12*a* along the radial direction, as shown in FIG. 8. Due to the protrusion of the tip end 32, a distance in the direction P between the adjacent outer rotor pieces 21 that surround one volume chamber 61 is gradually increased. Thus, the volume of the volume chamber 61 is gradually increased. When each volume chamber 61 sequentially passes through the vicinity of the discharge port 53 along arrow P1, the vane 30 gradually increases the amount of insertion of the base part 31*a* into the recess part 12*a* along the radial direction. Due to the insertion of the base part 31*a*, the distance in the circumferential direction between the adjacent outer rotor pieces 21 that surround one volume chamber 61 is gradually decreased. Thus, the volume of the volume chamber 61 is gradually decreased.

The slide position of the tip end 32 of the vane 30 located radially outward is changed in response to the eccentricity of the outer rotor 20 with respect to the inner rotor 10, following the rotational movement of the outer rotor 20, whereby the volume chamber 62 repetitively operates to increase or decrease its volume. Specifically, when each volume chamber 62 sequentially passes through the vicinity of the suction port 52, the amount of protrusion of the vane 30 is increased, and the adjacent outer rotor pieces 21 are displaced in the direction away from each other so that the distance between the outer rotor pieces 21 in the circumferential direction is gradually increased. Thus, the volume of the volume chamber 62 including the engagement spaces 5 and 6 is gradually increased. When each volume chamber 62 sequentially passes through the vicinity of the discharge port 53, the amount of insertion of the vane 30 is increased, and the adjacent outer rotor pieces 21 are displaced in the direction toward each other so that the distance between the outer rotor pieces 21 in the circumferential direction is gradually decreased. Thus, the volume of the volume chamber 62 including the engagement spaces 5 and 6 is gradually decreased.

The plurality of vanes 30 are slid in the radial direction in response to the eccentricity of the outer decrease its volume in the vane-housing unit 12. Specifically, when each volume chamber 63 sequentially passes through the vicinity of the suction port 52, the amount of protrusion of the vane 30 is increased, and the volume of the volume chamber 63 is gradually increased. When each volume chamber 63 sequentially passes through the vicinity of the discharge port 53, the amount of insertion of the vane 30 is increased, and the volume of the volume chamber 63 is gradually decreased.

In the oil pump 100, enlargement and shrinkage of the volume chamber 61 located between the adjacent vanes 30, the volume chamber 62 formed between the outer rotor pieces 21 that engage with each other in the circumferential direction in this part, and the volume chamber 63 through the communication passage 13 are synchronized. Thus, when passing through the vicinity of the suction port 52, a set of the volume, chambers 61 to 63 in terms of a flow passage suctions the oil 1 while increasing their volumes, and when passing through the vicinity of the discharge port 53, a set of the volume chambers 61 to 63 in terms of a flow passage discharges the oil 1 while decreasing their volumes.

In the oil pump 100, changes from the volume decreased state of a set of volume chambers 61 to 63 to the volume increased state of a set of volume chambers 61 to 63 and from the volume increased state of a set of volume chambers 61 to 63 to the volume decreased state of a set of volume chambers 61 to 63 in one rotation are sequentially made along with about 51.43 degree phase shifting for each set of volume chambers so that continuous pumping is implemented. The drive force of the drive source rotates the inner rotor 10, and rotates the outer rotor 20 annularly connected outside the inner rotor 10 through the vanes 30. At this time, the seven outer rotor pieces 21 periodically change their engagement states so that pumping is generated in the outer rotor 20. Furthermore, the drive force of the drive source moves the vanes 30 back and forth on the basis of the eccentricity of the outer rotor 20 when rotating the inner rotor 10 and the outer rotor 20. At this time, in addition to moving the vanes 30 back, and forth, pumping resulting from enlargement and shrinkage of volume chambers 63 is generated also in the recess parts 12*a*.

Thus, in the oil pump 100, all the deformation movement of the volume chambers 61 to 63 that exist in the housing 40 and are deformed along with the rotation of the inner rotor 10 is converted to pumping. At this time, the vanes 30 each having the unnarrowed base 31 and a contact thickness T are used, and hence no factor to increase the volumes of the volume chambers 61 is generated during a decrease in the volumes of the volume chambers 63, and synchronous changes in the volumes of the volume chambers 61 to 63 effectively work on overall pumping. In the oil pump 100, the deformation movement of not only the volume chambers 61 but also the volume chambers 62 and 63 is incorporated in pumping, and hence the volumes of the volume chambers 62 and 63 are effectively added to the volumes of the volume chambers 61. This means that a net rate of discharge of the oil 1 per unit rotation is increased.

According to this embodiment, the following effects can be obtained.

According to this embodiment, the net rate of discharge of the oil 1 per unit rotation in the oil pump 100 can be sufficiently increased. Consequently, the pumping efficiency of the oil pump 100 can be improved.

According to this embodiment, the pumping of the volume chambers 62 on the side of the outer rotor 20 is added to the volume chambers 61 that efficiently ensure the rate of discharge of the oil 1, and hence the rate of discharge of the oil 1 can be efficiently increased. When compared at the same rate of discharge, therefore, the oil pump 100 can be reduced in size by reducing the rotor width L1 (see FIG. 1), for example, and hence the mountability of the oil pump 100 to the engine or the like can be improved. Furthermore, the oil, pump 100 is reduced in size so that a mechanical loss during driving of the oil pump 100 can be reduced, and hence the load, of the drive source that drives the oil pump 100 is reduced so that the energy cat be saved.

According to this embodiment, each of the outer rotor pieces 21 engages with a part of the second end surface 21*d* including the groove part 27 of the adjacent outer rotor piece 21 through a part of the first end surface 21*c* including the rail part 26 such that the distance therebetween in the direction P (circumferential direction) is variable. In other words, a contact part between the outer rotor pieces 21 can be limited only to an overlapping part in the circumferential direction between the first end surface 21*c* and the second end surface 21*d* in the X-axis direction, and hence a sliding resistance between the outer rotor pieces 21 can foe reduced. Furthermore, the volume chamber 62 can be configured by only engagement between the rail part 26 and the groove part 27, and hence the thickness (the widths of the first end surface 21*c* and the second end surface 21*d*) of each of the outer rotor pieces 21 in the radial direction can also be further reduced within a range in which the strength can be maintained so that the weight can be reduced. The reduction in the sliding resistance between the outer rotor pieces 21 of the outer rotor 20 annularly circumferentially) connected to each other and the reduction in weight lead to a reduction in mechanical loss, which can further contribute to a reduction in the load of the drive source (energy saving).

According to this embodiment, the first end surface 21*c* and the second end surface 21*d* provided inward of the end surfaces 21*f* and 21*g* that serve as both ends in the X-axis direction of the outer rotor pieces 21 adjacent to each other face each, whereby the rail part 26 and the groove part 27 can reliably engage with each other. Thus, the volume chambers 62 (see FIG. 8) having the pumping function can foe easily configured.

According to the embodiment, the outer rotor piece 21 on one side and the outer rotor piece 21 on the other side are relatively slid in a state where the arcuate rail part 26 of the outer rotor piece 21 on one side and the arcuate groove part 27 of the outer rotor piece 21 on the other side engage with each other, whereby sliding in an arcuate manner is easily enabled, and hence the distance between the adjacent outer rotor pieces 21 in the circumferential direction can be easily changed in a forward direction and a backward direction along the circumferential direction. Therefore, the volume of the volume chamber 62 (the engagement spaces 5 and 6) formed between the adjacent outer rotor pieces 21 is increased (decreased) along the circumferential direction so that the pumping function can be provided.

According to this embodiment, the outer rotor pieces 21 can be easily relatively slid in an arcuate manner in a state where the arcuate rail part 26 of the outer rotor piece 21 on one side and the arcuate groove part 27 of the outer rotor piece 21 on the other side engage with each other. Furthermore, a periodic change in the volume of the volume chamber 62 can be achieved by a simple engagement structure in which the rail part 26 is fitted into the groove part 27, and hence the durability of the outer rotor 20 can be easily maintained.

According to this embodiment, the outer rotor pieces 21 can be easily relatively slid in an arcuate manner in a state where the rail part 26, which extends in an arcuate manner, of the outer rotor piece 21 on one side engages with (is fitted into) the groove part 27, which extends in an arcuate manner, of the outer rotor piece 21 on the other side. In this case, one end 27*a* of the groove part 27 is open, whereby the oil 1 in the groove part 27 can be discharged from one end 27 (open end) according to a decrease in volume even under the circumstances in which the rail part 26 is slidingly inserted into the groove part 27 in the circumferential direction so that the spatial volume of the groove part 27 is decreased, and hence liquid compression of the oil 1 in the groove part 27 can be avoided. Thus, each of the outer rotor pieces 21 can smoothly slide in the circumferential direction, and hence the periodic change in the volume of the volume chamber 62 (the engagement spaces 5 and 6) can be smoothly made.

According to this embodiment, the clearance S can be formed between the top surface 26*a* of the rail part 26 and the bottom surface part 27*b* of the groove part 27 in an engaging state where the rail part 26 is fitted into the groove part 27, and hence this clearance S serves as a flow path for oil discharge so that the oil 1 in the groove part 27 can be easily discharged from one end 27*a* (open end) even when the rail part 26 is slidingly inserted into the groove part 27 in the circumferential direction. Therefore, liquid compression of the oil 1 can be easily avoided.

According to this embodiment, the radially outermost surface 3 of each of the outer rotor pieces 21 can be configured such that the outer peripheral surface 3*a* of the first part 21*a* and the outer peripheral surface 3*b* of the second part 21*b* circumferentially continue without steps. Therefore, the thickness of each of the outer rotor pieces 21 in the radial direction can be reduced due to no steps, and hence the diameter of the outer rotor 20 can be reduced.

According to this embodiment, the oil pump 100 can be configured to incorporate the change in the volume of the volume chambers 63 in the vane-housing unit 12 by linear sliding of the vanes 30 in the radial direction with respect to the vane-housing unit 12 into pumping including suction and discharge of the oil 1 without ignoring the change in the volume of the volume chambers 63 in addition to the pumping of the volume chambers 61 and 62, and hence the pumping of the volume charters 63 is effectively added so that the rate of discharge of the oil 1 per unit rotation that the oil pump 100 has can be further increased. Consequently, the oil pump 100 can be further reduced in size. Furthermore, the vanes 30 that linearly slide in the radial direction are used, and hence it is not necessary to narrow an intermediate part of each of the vanes 30 that appear from and disappear into the vane-housing unit 12. Therefore, no wasted work to newly increase the volume in parts on the side of the volume chambers 61 in the vicinity of the volume chambers 63 is generated during a decrease change in the volume of the volume chambers 63, and hence the changes in the volumes of the volume chambers 61 to 63 can effectively work on the pumping of the entire oil pump 100.

The embodiment disclosed this time must be considered as illustrative in all points and not restrictive. The range of the present invention is shown not by the above description of the embodiment but by the scope of claims for patent, and all modifications within the meaning and range equivalent to the scope of claims for patent are farther included.

For example, while the rail part 26 is formed in the first end surface 21*c* of the outer rotor piece 21 and the groove part 27 is formed in the second end surface 21*d* of the outer rotor piece 21 in the aforementioned embodiment, the present invention is not restricted to this. The groove part 27 may be formed in the first end surface 21*c*, and the rail part 26 may be formed in the second end surface 21*d*.

While the rail part 26 is formed in an arcuate shape along the arcuate shape of the first end surface 21*c* in the aforementioned embodiment, the present invention is not restricted to this. In other words, a pin-shaped (columnar) engaging part (first engaging part) that serves as the "convex part" according to the present invention may be provided in the first end surface 21*c*. In addition, pin-shaped engaging parts may be aligned in an arcuate manner at predetermined intervals to form the "first engaging part".

While the oil pump 100 is configured by arranging the seven vanes 30 between the inner rotor 10 and the outer rotor 20 in the aforementioned embodiment, the present invention is not restricted to this. The number of vanes 30 may be five, six, or eight, for example, other than seven.

While the crankshaft of the internal combustion engine is used as the drive source for the inner rotor 10 in the aforementioned embodiment, the present invention is not restricted to this. For example, an electric motor may be used as the drive source for the oil pump.

While the rate of discharge is varied in response to the eccentricity by moving the housing 40 parallel to the inner rotor 10, the rotation center R of which is fixed inside the pump body 50, in the aforementioned embodiment, the present invention is not restricted to this. The rate of discharge may be varied by providing a rotational fulcrum on one side of the housing 40 and rotating another side of the housing 40 by a predetermined angle about this rotational fulcrum, for example, to generate the eccentricity of the outer rotor 20.

While the center of the housing 40 is shifted with respect to the inner rotor 10, the rotation center R of which is fixed, in the aforementioned embodiment, the present invention is not restricted to this. In other words, the rotation center R of the inner rotor 10 may be movable so that the inner rotor 10 is eccentric with respect to the fixed housing 40 and the rate of discharge is varied.

While the oil pump 100 is configured to rotate the outer rotor 20 in the same direction by rotating the inner rotor 10 along arrow P1 in the aforementioned embodiment, the present invention is not restricted to this. For example, the inner rotor 10 may be rotated along arrow P2. In other words, the vanes 30 are configured to repetitively linearly appear from and disappear into the inner rotor 10 along the radial direction, and hence the rotation direction of the inner rotor 10 is not limited.

While the rate of discharge is varied in response to the eccentricity by moving the housing 40 parallel to the inner rotor 10, the rotation center R of which is fixed inside the pump, body 50 in the aforementioned embodiment, the present invention is not restricted to this. The oil pump may be configured to keep the rate of discharge constant in response to the constant eccentricity without the parallel movement of the housing 40.

While the present invention is applied to the oil pump 100 that supplies the oil 1 to the internal combustion engine in the aforementioned embodiment, the present invention is not restricted to this. The present invention may be applied to an oil pump for supplying AT fluid (AT oil) to an automatic transmission that automatically switches a transmission gear ratio in response to the rotational speed of the internal combustion engine, or an oil pump that supplies lubricating oil to a slide part in a continuously variable transmission (CVT) capable of continuously varying a transmission gear ratio unlike the aforementioned AT (multistage transmission), for example. Alternatively, the present invention may be applied to an oil pump that supplies power steering oil to a power steering that drives a steering.

While the oil pump 100 is mounted on a vehicle including the internal combustion engine (engine) in the aforementioned embodiment, the present invention is not restricted to this. The present invention may be applied to an oil pump mounted on an equipment instrument including an internal combustion engine, for example.

DESCRIPTION OF REFERENCE SIGNS

3 radially outermost surface
5, 6 engagement space
10 inner rotor
12 vane-housing unit
20 outer rotor
21 outer rotor piece
21*a* first part
21*b* second part
21*c* first end surface
21*d* second end surface
21*e* base (vane-connecting part)
21*j* engaging part (vane-connecting part)
26 rail part (first engaging part, convex part)
27 groove part (second engaging part, concave part)
30 vane
40 housing
50 pump body
61 volume chamber (first volume-changing part)
62 volume chamber (second volume-changing part)
63 volume chamber (third volume-changing part)
100 oil pump

The invention claimed is:

1. An oil pump comprising:

a rotatable inner rotor including a vane-housing unit that houses a plurality of vanes such that the plurality of vanes is slidable in a radial direction;

a rotatable annular outer rotor including a plurality of vane-connecting parts connected with tip ends of the plurality of vanes located radially outward;

a first volume-changing part, which is provided between the rotatable inner rotor and the rotatable annular outer rotor, a first volume of which is changed in response to eccentricity of the rotatable inner rotor with respect to the rotatable annular outer rotor, thereby providing a pumping function; and a second volume-changing part, which is provided in the rotatable annular outer rotor, a second volume of which is changed by a change in a distance between the plurality of vane-connecting parts adjacent to each other in a circumferential direction in response to the eccentricity of the rotatable inner rotor with respect to the rotatable annular outer rotor, thereby providing a pumping function, wherein the rotatable annular outer rotor includes a plurality of outer rotor pieces annularly connected to each other, each of the plurality of outer rotor pieces includes a first engaging part provided in a first end surface of each of the plurality of outer rotor pieces in an axial direction and a second engaging part provided in a second end surface of each of the plurality of outer rotor pieces in the axial direction and being engageable with the first engaging part of an adjacent one of the plurality of outer rotor pieces, the plurality of outer rotor pieces is circumferentially arranged in a state where the first engaging part and the second engaging part of the plurality of outer rotor pieces being adjacent to each other engage with each other such that a distance therebetween in the circumferential direction is variable, the first engaging part is provided in the first end surface of each of the plurality of outer rotor pieces in the axial direction to extend in an arcuate manner, the second engaging part is provided in the second end surface of each of the plurality of outer rotor pieces in the axial direction to extend in the arcuate manner, the first engaging part and the second engaging part engage with each other such that the same are slidable in the circumferential direction with respect to each other in an engaging state, the first engaging part is formed by one of a convex part and a concave part provided in the first end surface of each of the plurality of outer rotor pieces in the axial direction to extend in the arcuate manner, and the second engaging part is formed by the other of the convex part and the concave part provided in the second end surface of each of the plurality of outer rotor pieces in the axial direction to extend in the arcuate manner and being engageable with the first engaging part of the adjacent one of the plurality of outer rotor pieces.

2. The oil pump according to claim 1, wherein the first end surface and the second end surface are end surfaces provided inward of both ends of each of the plurality of outer rotor pieces in the axial direction.

3. The oil pump according to claim 1, wherein the convex part is a rail part that extends in the arcuate manner, and the concave part is a groove part that engages with the rail part and extends in the arcuate manner, one end of the groove part is open.

4. The oil pump according to claim 3, wherein a depth of the groove part in the axial direction is larger than a protruding height of the rail part.

5. The oil pump according to claim 1, wherein each of the plurality of outer rotor pieces includes:

a first part that extends in the arcuate manner to one side in the circumferential direction with respect to each of the vane-connecting parts and includes the first end surface provided with the first engaging part, and a second part that extends in the arcuate manner to the other side in the circumferential direction with respect to each of the vane-connecting parts and includes the second end surface provided with the second engaging part, and a radially outermost surface of each of the plurality of outer rotor pieces includes an outer peripheral surface of the first part and an outer peripheral surface of the second part.

* * * * *